US005803143A

United States Patent [19]

Willis

[11] Patent Number: 5,803,143

[45] Date of Patent: Sep. 8, 1998

[54] METHOD AND APPARATUS FOR PRODUCING WOOD WAFERS

[76] Inventor: Bobby G. Willis, 2420 York St., Eugene, Oreg. 97404

[21] Appl. No.: 551,871

[22] Filed: Oct. 23, 1995

[51] Int. Cl.[6] ..... B27C 1/00; B27L 11/00

[52] U.S. Cl. ..... 144/373; 144/174; 144/230; 144/241; 144/172; 241/294

[58] Field of Search ..... 241/91, 92, 93, 241/294, 296; 144/39, 41, 42, 162.1, 172, 174, 230, 241, 373

[56] References Cited

U.S. PATENT DOCUMENTS

| | | | |
|---|---|---|---|
| 2,969,816 | 1/1961 | Johnsa | 144/230 |
| 2,997,082 | 8/1961 | Schubert et al. | 144/230 |
| 3,017,912 | 1/1962 | Sybertz et al. | 144/230 |
| 3,025,895 | 3/1962 | Girard | 144/172 |
| 3,209,801 | 10/1965 | Little et al. | 144/172 |
| 3,219,076 | 11/1965 | Logan et al. | 144/42 |
| 3,314,459 | 4/1967 | Beaubien | 144/172 |
| 3,783,916 | 1/1974 | Nicholson et al. | 144/172 |
| 3,814,154 | 6/1974 | Nicholson | 144/172 |
| 3,866,645 | 2/1975 | Sybertz | 144/172 |
| 3,989,076 | 11/1976 | Zurcher | 144/42 |
| 4,077,450 | 3/1978 | Ackerman | 144/172 |
| 4,109,690 | 8/1978 | Berg | 144/174 |
| 4,785,860 | 11/1988 | Arasmith | 144/172 |

*Primary Examiner*—W. Donald Bray
*Attorney, Agent, or Firm*—Olson & Olson

[57] ABSTRACT

Wood wafers are produced by feeding logs to a rotary cutter head drum with the longitudinal axis of the logs disposed substantially parallel to the rotational axis of the drum. The drum mounts a plurality of wafer cutting head units arranged in a V-shaped pattern with the apex of the V trailing the base thereof and with the cutting blades defining the ends of the base positioned at the opposite ends of the operative length of the drum. Each wafer cutting blade having a cutting edge disposed substantially parallel to the axis of the drum and offset circumferentially and axially from an adjacent cutting blade so that the cut produced by a cutting blade overlaps the cut produced by the next adjacent preceding cutting blade.

12 Claims, 5 Drawing Sheets

METHOD AND APPARATUS FOR PRODUCING WOOD WAFERS

BACKGROUND OF THE INVENTION

This invention relates to wood wafers for use in making waferboard, paper pulp and other fiber products, and more particularly to a highly efficient method and apparatus for producing wood wafers of high quality and in high volume for use as pulp chips of superior quality.

It has been the practice heretofore, as exemplified by U.S. Pat. No. 4,135,563 to produce wood wafers and pulp chips by cutting the wood across the grain, as by feeding logs end-on into a chipper head, with or without the additional step of breaking the fibers at longitudinally spaced intervals. This procedure results in the production of an excessive proportion of chips of very irregular thicknesses, thereby correspondingly reducing the efficiency of the pulping process. In addition, the procedure requires an excessive amount of horsepower to cut cross-grain through the wood, and it is extremely noisy in operation. Further, the attendant hammering of the chipper blades against the logs produces severe strains on the machinery parts, requiring frequent shutdown for maintenance and repair.

In an effort to overcome the disadvantages of the earlier cross-grain chippers, pulp chips and wood wafers for particleboard production also have been produced by cutting wood parallel to the grain and establishing the length of the chips or wafer by overlapping the cutting blades in the rotational direction of the cutter drum, or by employing scoring knives. Examples of these systems are disclosed in U.S. Pat. Nos. 4,077,450; 3,219,076; 3,025,895; 3,017,912; and 2,997,082. In all of these the cutter knives are positioned on the rotary drum on a plurality of circumferentially spaced rows extending parallel to the rotational axis of the drum, with the knives of each row spaced apart axially and with the knives of each row succeeding in the direction of drum rotation offset axially from the preceding row. By this arrangement the wood remaining between the preceding chips is removed from the wood. Accordingly, these systems require two rows of cutter knives to effect removal of chips from one layer of wood.

Although wood wafers are characterized by substantially uniform thickness, apparatus for their production heretofore has not been able to meet the volume demands of the paper industry. Moreover, they are designed to produce wafers which, while being suitable for structural particleboard, are too thin and otherwise dimensionally unacceptable for paper pulp.

SUMMARY OF THE INVENTION

In its basic concept, this invention provides for the production of wood wafers by presenting wood logs to a rotary drum cutter head with the grain of the logs disposed substantially parallel to the rotation axis of the drum and the cutting edges of a plurality of wafer cutting blades which are arranged in a V-shaped pattern with the apex of the pattern trailing in the direction of rotation of the drum and with the cutting blades defining the base of the V pattern located at the longitudinal ends of the drum, the cutting blades also being arranged to overlap each other in the circumferential direction of rotation of the cutter head, whereby to define the length and thickness of the wafer.

It is by virtue of the foregoing basic concepts that the principal objective of this invention is achieved; namely, to avoid the aforementioned limitations and disadvantages of prior art methods and apparatus for making wood wafers.

Another objective of this invention is the provision of method and apparatus for producing wood wafers, in which the horsepower required for operation is reduced to a minimum.

Still another object of this invention is the provision of method and apparatus for producing wood wafers by which to increase substantially the yield of wood wafers of high quality.

Another objective of this invention is the provision of method and apparatus for producing wood wafers of exceptional quality and in sufficient volume to be usable in the production of paper pulp.

A further objective of this invention is the provision of apparatus for producing wood wafers in which wafer cutting blades are provided with two cutting edges which are reversible for use to extend the operational life of the blade.

A still further objective of this invention is the provision of apparatus for producing wood wafers in which each assembly of wafer cutting blade is mounted as a unit for rapid and easy replacement on the rotary cutter head.

Another objective of this invention is to provide apparatus for producing wood wafers in which the wafer cutting blade of a unit is replaceable independently of each other.

A further objective of this invention is the provision of apparatus for producing wood wafers in which each unitary assembly of wafer cutting blade is mounted on a rotary drum by removable support segments which allow each unitary assembly to be replaced without disturbing the others.

Still another objective of this invention is to provide apparatus for producing wood wafers in which logs of random diameter may be fed as a group to the rotary cutter head.

The foregoing and other objects and advantages of this invention will appear from the following detailed description, taken in connection with the accompanying drawings of a preferred embodiment.

DESCRIPTION OF THE PREFERRED EMBODIMENT

Figure 1:
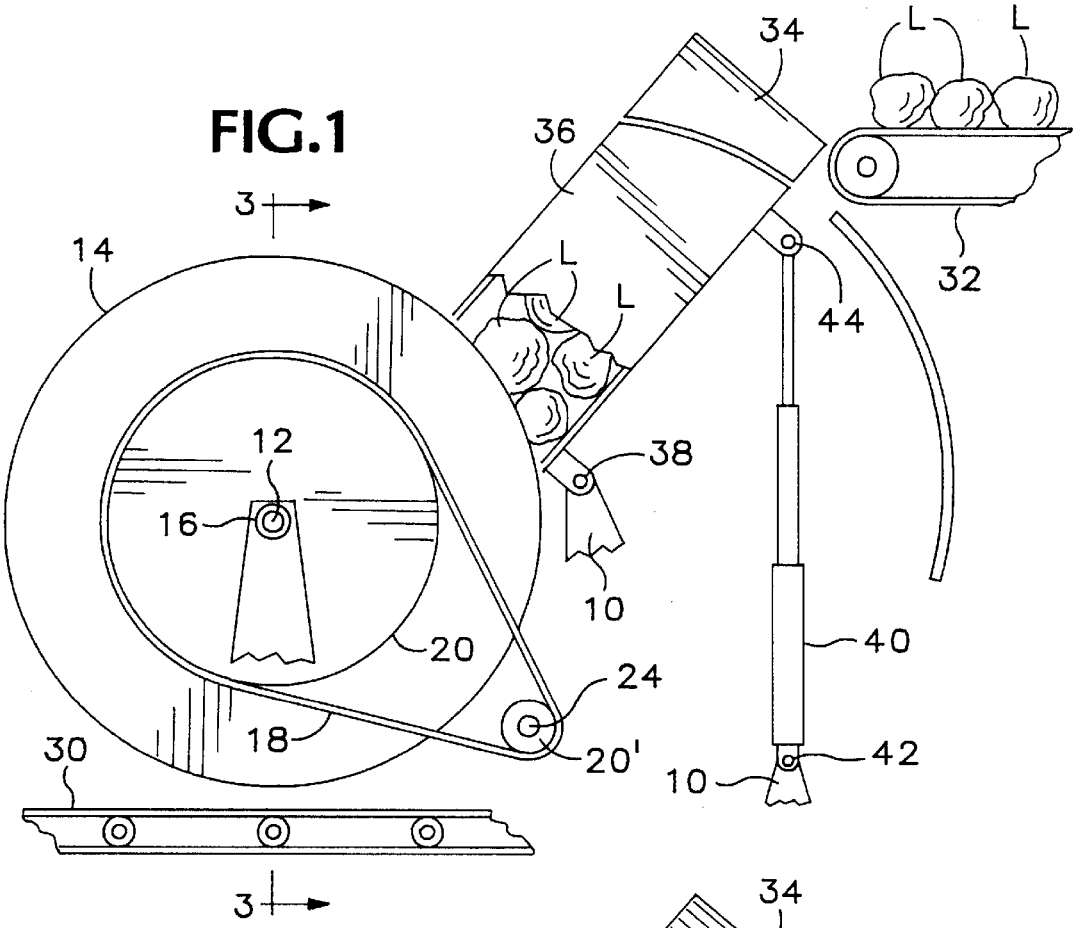
FIG. 1 is a fragmentary side elevation of apparatus embodying the features of this invention, a portion being broken away to disclose internal detail, the log infeed hopper being disposed in operative position.
Figure 2:
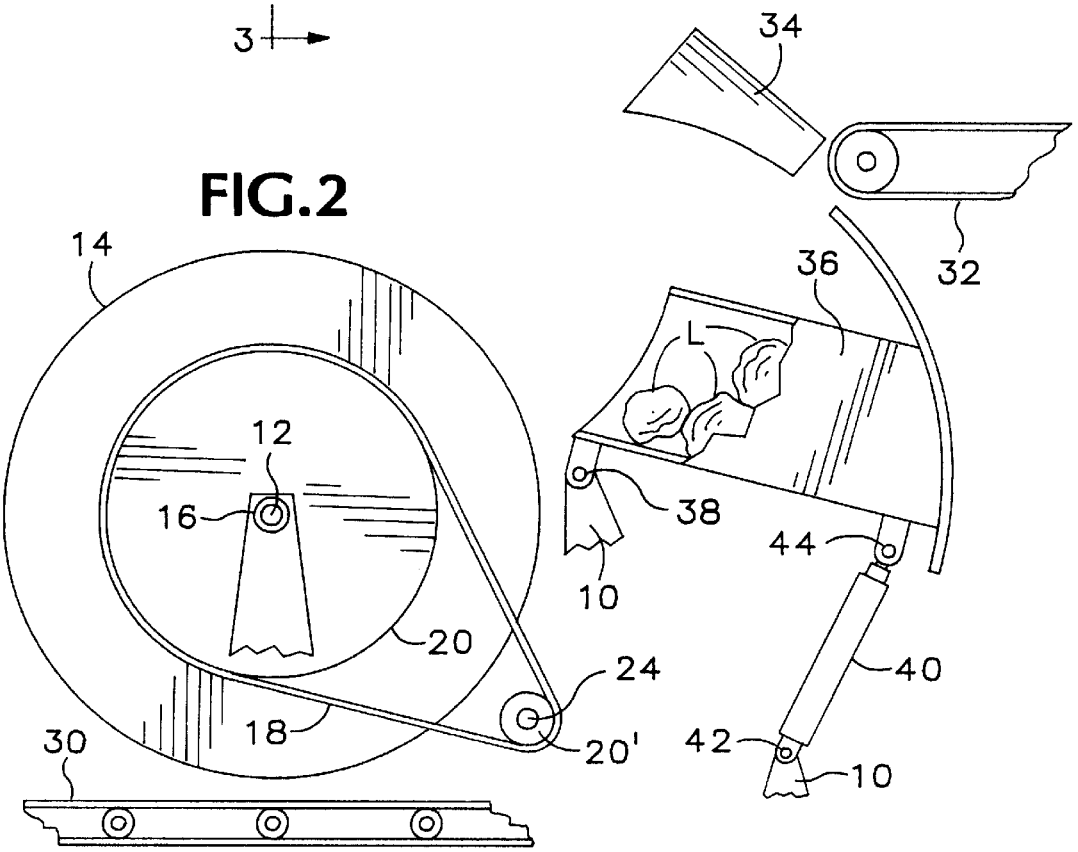
FIG. 2 is a fragmentary side elevation of the apparatus shown in FIG. 1, with the log infeed hopper disposed in retracted position to expose the drum for maintenance.
Figure 3:
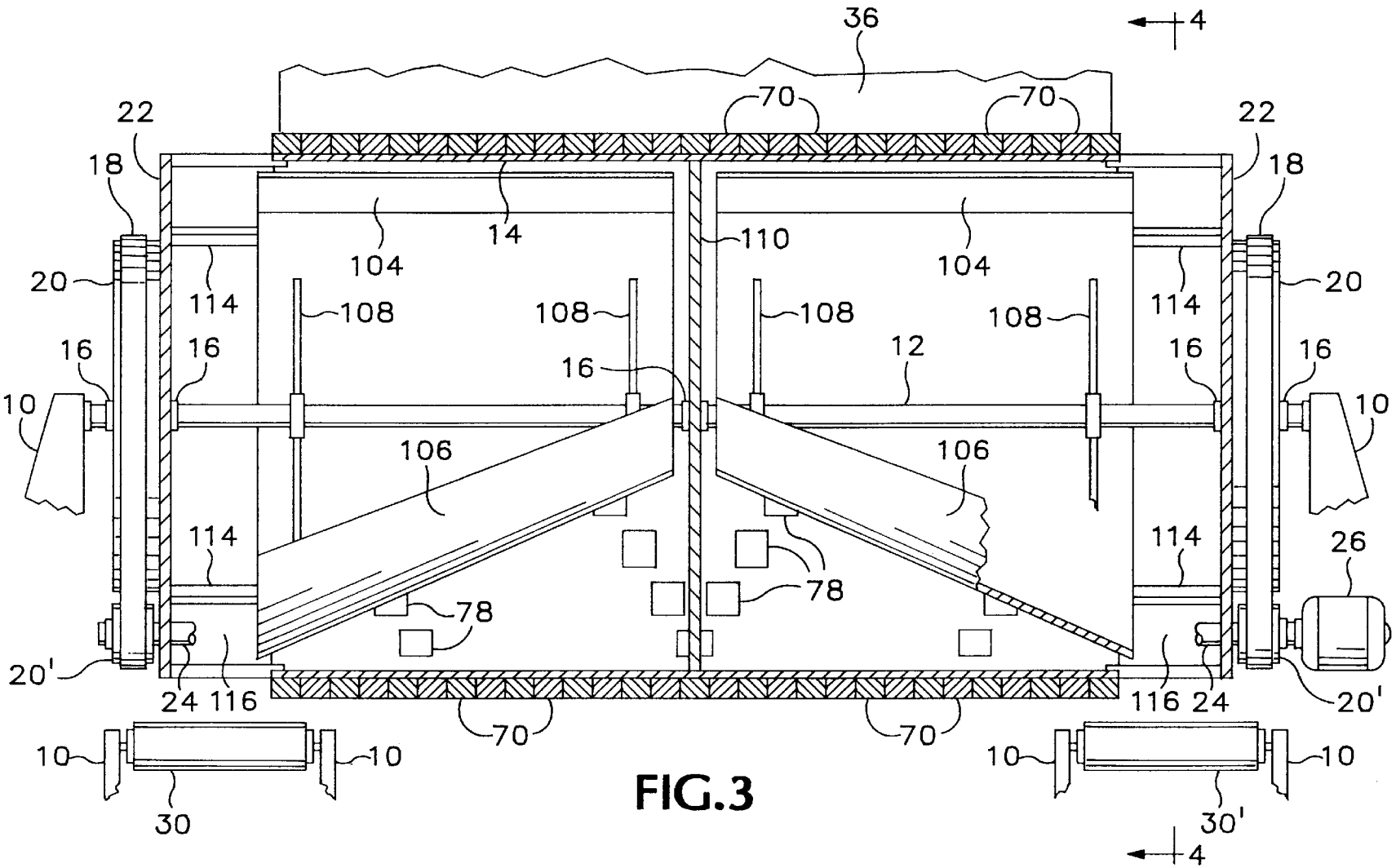
FIG. 3 is a fragmentary vertical sectional view, on an enlarged scale, taken on the line 3—3 in FIG. 1.

Referring primarily to FIGS. 1, 2 and 3 of the drawings, the apparatus is illustrated in somewhat schematic form in FIGS. 1 and 2. It includes the framework 10 which mounts a non-rotatable shaft 12. A hollow rotary drum 14 is mounted for rotation on the shaft, as by bearings 16. Rotation of the drum is effected by drive belts 18 trained over pulleys 20 secured to the opposite end plates 22 of the drum and engaging drive pulleys 20' at the opposite ends of a drive shaft 24 mounted for rotation on frame 10. The shaft is connected to the output drive shaft of an electric motor 26.

Secured to the outer surface of the drum, in a manner explained in detail hereinafter, are a plurality of wafer cutting units 28 (FIGS. 5, 7 and 8) each of which functions to cut from wood logs an individual wood wafer of predetermined and precise thickness and lateral length, i.e. length parallel to the rotational axis of the drum. The wafers thus cut from the log pass inwardly through discharge passageways in the wafer cutting unit and drum, and are collected, by means described hereinafter, on outfeed conveyors 30 and 30' which are disposed adjacent opposite ends of the drum.

Logs L are delivered to the outer periphery of the drum for reduction to wafers. In the embodiment illustrated, a conveyor 32 delivers logs through a fixed infeed funnel 34 to the upper end of a log hopper 36. The hopper is mounted on frame 10 for adjustment between a downwardly extending log delivery position (FIG. 1) and a retracted position (FIG. 2) for rendering the drum accessible for maintenance. Adjustment of the hopper is afforded by the lower mounting pivot 38 on frame 10 and by the extensible and retractable piston-cylinder unit 40 mounted at its lower end on the frame 10 by pivot 42 and secured at its upper end to the hopper by pivot 44.

It is to be noted from FIGS. 1 and 2 that the logs L are fed to the rotary drum with the longitudinal axis of the logs disposed substantially parallel to the rotational axis of the drum. As will become apparent hereinafter, the logs thus are reduced to wafers by cutting them from the log in the direction parallel to the longitudinal axis of the logs. This is the same direction in which plywood veneer is pealed from a log. However, whereas plywood veneer is pealed as a single continuous sheet from across the full length of the log, the wood wafers are produced in accordance with this invention by use of a multiplicity of wafer cutting blades mounted along the length and circumference of the drum in such a manner that each blade produces its own discrete wood wafer.

Figure 7:
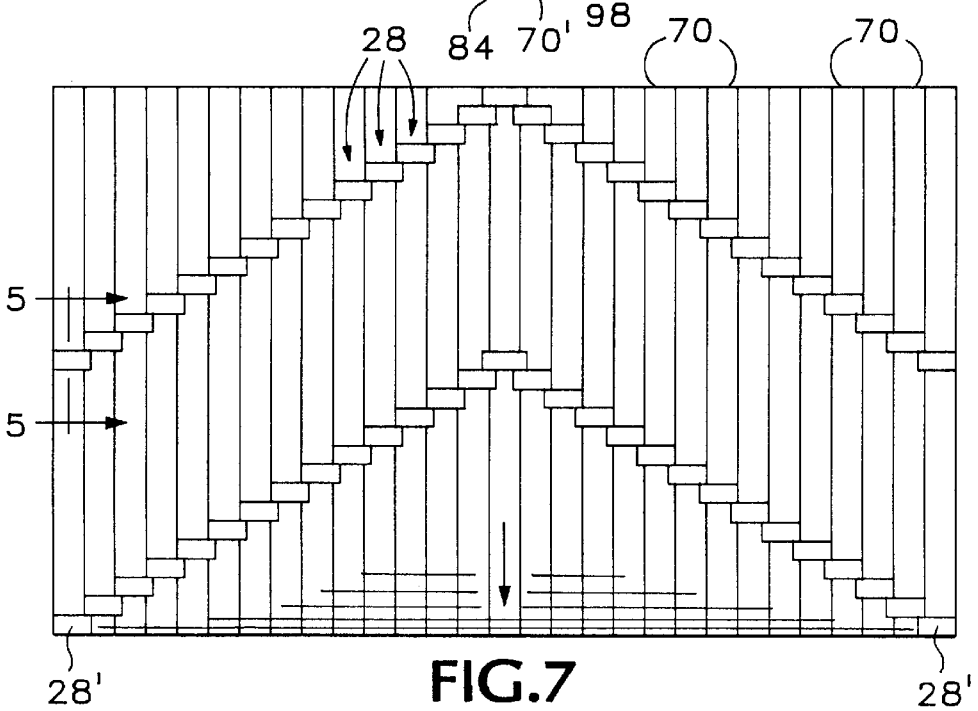
FIG. 7 is a plan view of the rotary drum of FIG. 3 illustrating an arrangement of a plurality of wafer producing cutter units on the drum in a pair of adjacent V-shaped patterns.

To illustrate the foregoing, reference is made to FIG. 7 which shows a plurality of individual wafer cutting units 28 mounted on the outer circumference of the drum in a pair of adjacent V-shaped patterns, with the apex of the V trailing the base thereof in the indicated direction of rotation of the drum. The cutter units 28' defining the base of each V-shaped pattern lead in the direction of rotation of the drum and are located at the opposite longitudinal ends of the operating length of the drum. Since these leading end cutters engage the log simultaneously, as do inward pairs therefrom, complete stability of the log during cutting is maintained.

Figure 6:
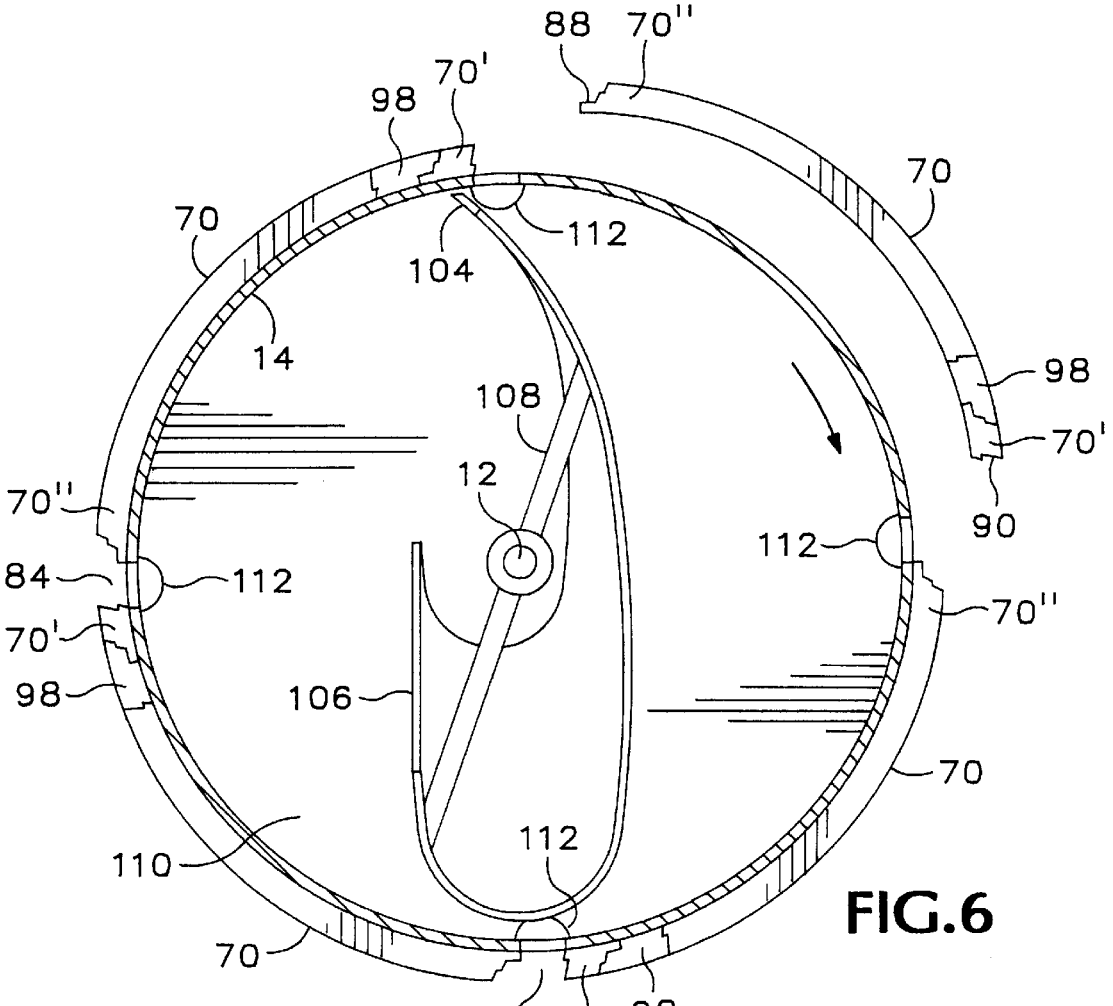
FIG. 6 is a sectional view, similar to FIG. 4, showing the manner of assembly of cutter head support segments on the rotary drum.

A plurality of these V-shaped patterns of units preferably are provided around the drum, for example at 90° intervals, as illustrated in FIG. 6. Accordingly, with four V-shaped patterns of cutting blades on the drum, four layers of wood wafers are removed from a log with one revolution of the drum. In any event, the wafer cutting units are arranged to overlap slightly in the direction of rotation of the drum, which is toward the bottom in FIG. 7, so that a preceding unit will define one end of a wood wafer to be cut by the next succeeding unit. It is by means of this V-shaped pattern of cutting blades that precisely dimensioned wafers are produced without the need for scoring knives.

Figure 5:
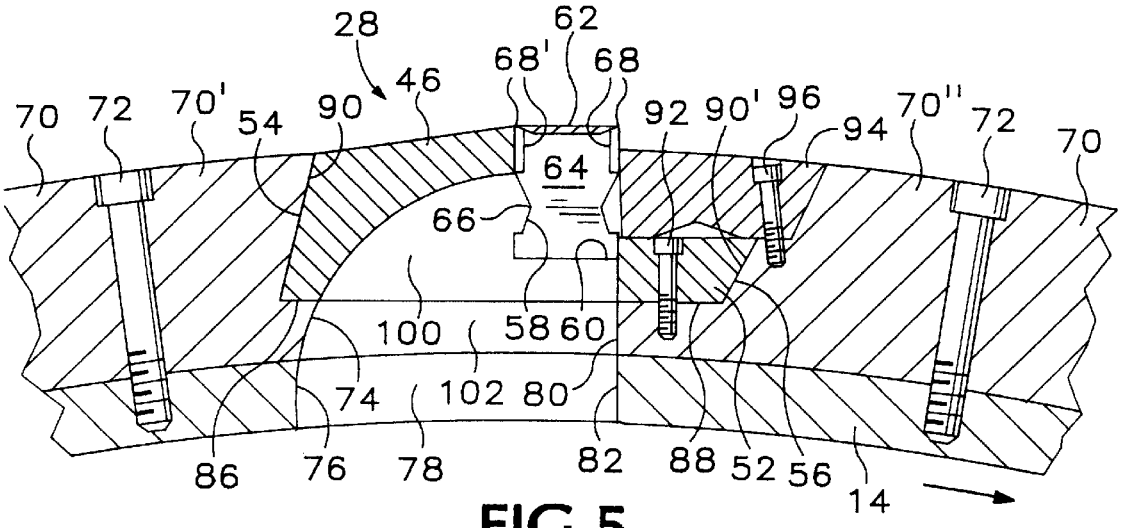
FIG. 5 is a sectional view, on an enlarged scale, taken on the line 5—5 in FIG. 7, of a portion of a rotary cutter head and drum showing the manner in which the wafer cutting unit of FIG. 8 is mounted on the rotary drum.
Figure 8:
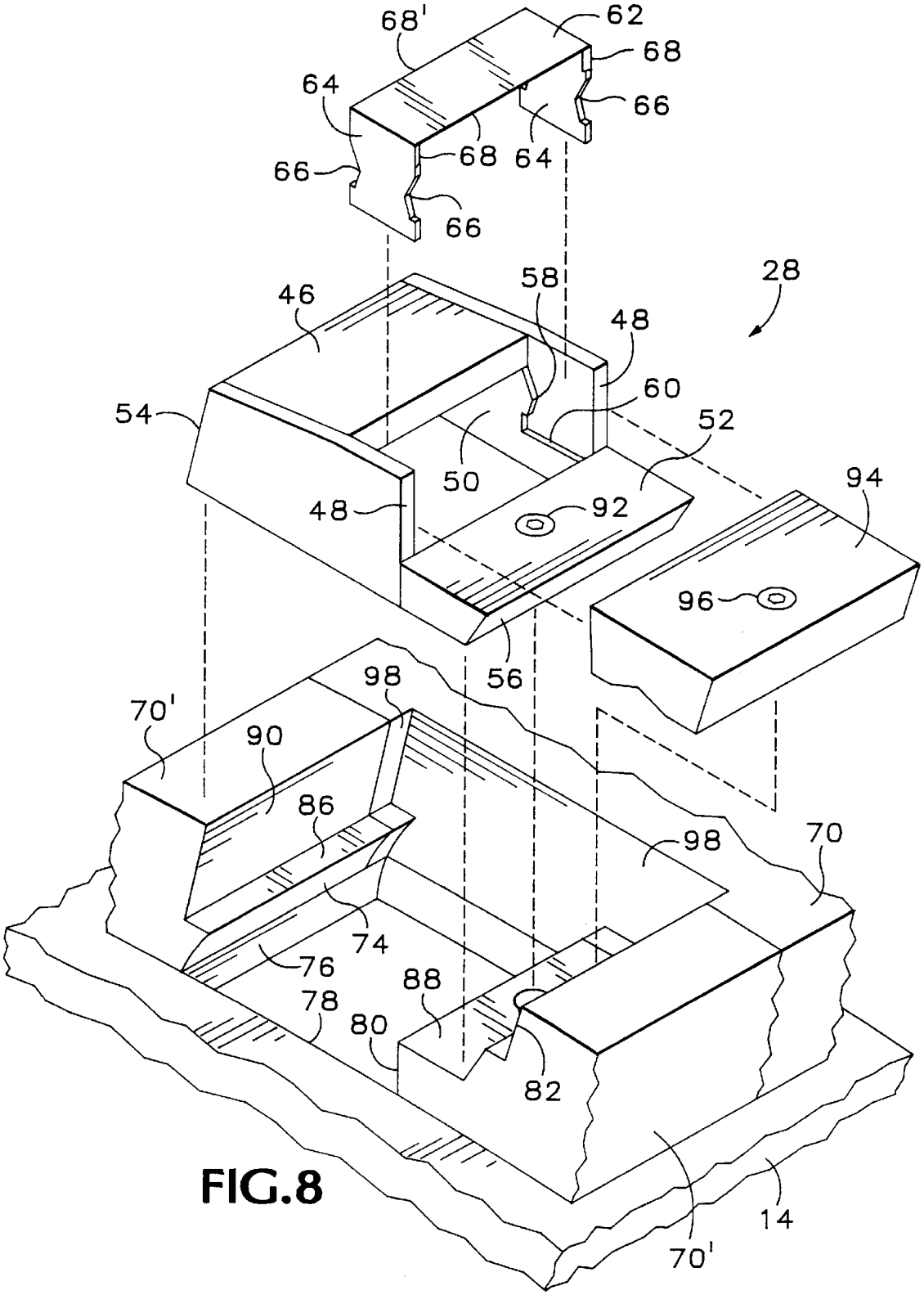
FIG. 8 is an exploded view in perspective of the wafer cutting blade and blade mounting components forming a wafer cutting unit for mounting with a plurality of identical units on the outer circumference of a rotary drum.

Referring primarily to FIGS. 5 and 8 of the drawings, each wafer cutting unit 28 includes a base member 46 which is formed of outer side walls 48, inner side walls 50 and front anchor 52. The rear side 54 of the base and the front side 56 of the front anchor 52 are tapered downwardly in the trailing direction of rotation of the drum. The forward ends of the inner side walls 50 are shaped with a forwardly projecting V-shaped catches 58 for securing a cutter blade against displacement, as described hereinafter.

The inner side walls 50 extend forwardly of the catches 58 to form an upper supporting surface 60 for the blade. The inner side walls and supporting surface 60 terminate at the rearward side of the front anchor 52, whereby to secure the blade against forward displacement.

The base member 46 thus described serves to mount integrally therewith a transverse wafer cutting blade 62. As illustrated, the blade is U-shape in transverse profile. The downwardly extending spaced side legs 64 are configured for reception freely between the inner surfaces of the outer side walls 48 of the base member for resting upon the horizontal supporting surface 60. The side legs have notches 66 on both fore and aft edges to receive the catches 58, whereby the blade is secured against displacement.

The wafer cutting blade 62 extends between the side walls 48 and is provided with sharpened transverse and end edges 68 which faces the direction of rotation of the drum. The sharpened end edges extend inward from the transverse edge sufficiently to accommodate the cutting of wafers of various thicknesses. In the preferred embodiment illustrated, the rearward edges 68' of the cutting blade are sharpened. Thus, since the blade is symmetrical about a transverse central plane through the blade and legs, the blade may be reversed when one cutter edge becomes dull, thereby doubling the life of the blade between sharpenings or replacement.

The plurality of wafer cutting units 28 are secured to the outer circumference of the drum by means of a plurality of spacer bar segments 70 of arcuate contour which are placed end-to-end around the circumference of the drum to form a ring. A plurality of the rings are placed side-by-side over the entire length of the drum. As illustrated in FIGS. 5, 7 and 8, bar segments 70 are secured to the drum by screws 72.

The end portion 70' of each bar segment 70 leading in the indicated direction of rotation of the drum (FIG. 5) is positioned with its leading edge 74 registering with the trailing edge 76 of an opening 78 in the drum 14. The trailing edge 80 of the trailing end portion 70" of an adjacent leading bar segment 70 is positioned to register with the leading edge 82 (FIG. 5) of the opening 78. The space between the leading and trailing end portions 70' and 70" of adjacent bar segments 70 provides a cavity 84 (FIG. 6) in which to receive the base member 46 of the wafer cutting unit 28.

The bottom edge of the base member rests upon a ledge 86 formed in the leading end point 70' of a bar segment 70 above the leading edge 74 and upon a ledge 88 formed in the trailing end portion 70" of the next adjacent leading bar segment 70 above the trailing edge 80. The leading upper edge 90 of the leading end portion 70' of a trailing bar segment 70 and the trailing edge 90' of the trailing portion 70" of the next adjacent leading bar segment 70 are tapered upwardly in the direction of rotation of the drum, to match the taper of the trailing end 54 of the base member 46 and the leading end of the front side 56 of front anchor 52, to prevent upward displacement of the base member.

The base member 46 is secured releasably to the trailing end portion 70" of a bar segment 70 by means of screw 92 extended through the front anchor 52. A clamp block 94 overlies the front anchor 52 and abuts the leading edges of the side legs 64 of the blade 62. The notches 66 thus are secured in the catches 58 to prevent outward displacement of the blade. The clamp block 94 is secured releasably to the trailing end portion 70" of the bar segment by screw 96.

The wafer cutting blade 62 is positioned on the drum 14 in such manner that the operative cutting edge 68 projects outwardly from the drum farther than the trailing cutting edge 68' of the blade, to prevent binding the blade against the log being cut. Also, the side legs diverge slightly from the blade 62 to facilitate removal of wood wafers cut by the blade.

It is to be noted that the wafer cutting blade 62 functions to cut from log a length of wood defining a single wafer. In order to insure against binding of the wafer blade in the wood and jamming of the wood wafers between the side legs 64 of the blade, as well as to provide sharply defined ends to the wood wafers, the blade-supporting base members 46 are made wider than the base-supporting bar segments 70, and one side edge of each blade-supporting base member is offset laterally on its bar segments 70 to overlap the adjacent side edge of the blade-supporting base member next succeeding in the direction of rotation of the drum 14. Thus, with reference to FIGS. 6 and 7 of the drawings, the bottommost base member 46 is received in a cavity 98 in the confronting side of the adjacent bar segment 70. The cutter blade 62 of this bottommost cutter unit cuts away a portion of the log that the next succeeding cutter blade cuts, so that the width of the wafer cut from the log is narrower than the space between the side legs 64 of the cutter blade.

In the illustrated embodiment, FIG. 7 shows an arrangement of bar segments 70 that provides two V-shaped pattern of cutter units secured in circumferentially spaced arrangement along the length of the drum. FIG. 6 shows four bar segments 70 which afford four such V-shaped patterns of wafer cutting units 28 disposed at 90° intervals about the drum 14. Accordingly, operation produces four thicknesses of wafers from a log per revolution of the drum. In contrast, the conventional prior art flakers described hereinbefore require at least two rows of cutting knives to produce a single thickness of wafer removal from a log. Thus, the present structural configuration of the wafer cutting units 28 effects an two-fold increase in the production of wafers or chips over prior art chippers and further allows production of wafers which are of the required dimensions usable for paper pulp.

It is to be noted in FIG. 7 that twenty-nine rings of segments 70 extend the length of the drum. If the wafer cutters are 2.25 inches (5.7 cm) wide, with 0.25 inch (6 mm) overlap, providing wafers of 2 inches (5 cm) long, the operating length of the drum is 58 inches (1.47 m). To provide a drum with an operating length of 8 feet (2.44 m) there will be forty-nine rings of segments 70. Other drum lengths and ring widths may be chosen, as desired.

Figure 4:
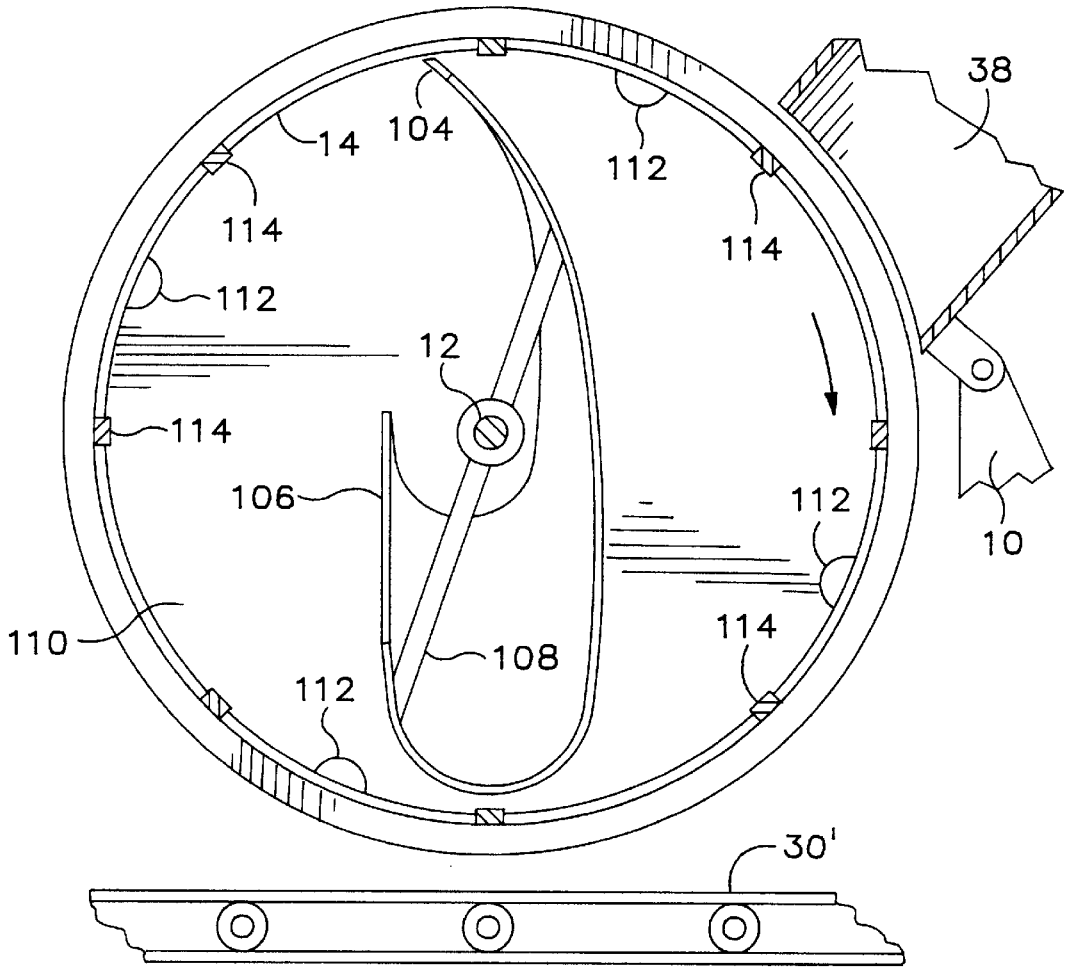
FIG. 4 is a fragmentary sectional view taken on the line 4—4 in FIG. 3.

Wood wafers cut from logs are retrieved in the following manner: The wafers pass inwardly under the cutter blade 62 and through the opening formed by the registering spaces 100 (FIG. 5) between the base member top wall and front anchor 52, the space 102 between the leading edge 74 of the leading end portion 70' of a bar segment 70 and the trailing edge 80 of the trailing end portion 70" of the next adjacent leading bar segment 70, and the opening 78 in the drum. The wafers fall by gravity into the hollow interior of the drum 14, where centrifugal force of rotation causes the wafers to be impinged against the interior surface of the drum. When the drum has rotated almost one complete revolution, the wafers are engaged by a flexible doctor blade 104 at the outer end of each of the collection chutes 106 (FIGS. 3, 4 and 6) which are mounted within the drum by brackets 108 secured to the fixed shaft 12. The chutes slope downwardly from the central reinforcing plate 110 of the drum, axially to the outer ends of the drum.

In order for wafers to exit the cutter blades 62 registering with the central plate 110, the plate is provided with openings 112 (FIGS. 4 and 6) registering with said cutter blades to allow wafers to enter the drum to opposite sides of the plate 110.

The opposite end portions of the drum are open circumferentially, as by means of circumferentially spaced arms 114 projecting axially outward of the solid portion of the drum. The outer ends of the arms support the end plates 22, and the open spaces 116 between the drum and end plates provide outlets through which wafers gravitate from the lower, outer ends of the chutes 106 for deposit on the underlying outfeed conveyors 30 and 30'.

It will be understood that a single collection chute may replace the two oppositely sloping chutes 106, with but one outfeed conveyor provided to receive the wafers exiting the lower end of the single chute.

The operation of the apparatus described hereinbefore provides a method of producing wood wafers of precisely dimensioned shape, whereby to maximize the production of wafers which are acceptable to the industry. Moreover, the wafers are produced with minimum machinery noise and by the utilization of a minimum of horsepower, since the wafers are cut from the wood by presenting the wood logs to the wafer cutting blades 62 with the wood grain disposed substantially parallel to the cutting edge 68 of the blades. Additionally, since each blade functions to produce an individual wood wafer of limited but precisely defined length, the power required is further minimized.

It will be apparent to those skilled in the art that various changes may be made in the process steps and in the size, shape, type, number and arrangement of parts described hereinbefore, without departing from the spirit of this invention and the scope of the appended claims.

I claim:

1. The method of producing wood wafers from logs, comprising:

a) disposing a log against the outer side of a rotary drum with the longitudinal axis of the log parallel to the rotational axis of the drum, and b) subjecting the log to the cutting action of a plurality of cutter blades arranged on the rotary drum in a plurality of said V-shaped patterns in circumferentially spaced positions around the drum and with the cutter blades in each V-shaped pattern disposed in rotational alignment with the cutter blades in each other V-shaped pattern and with the apex of each V trailing in the direction of rotation of the drum and with the leading base defined by cutter blades at the opposite longitudinal ends of the operating length of the drum and with the cutting edges of the blades substantially parallel to the longitudinal axis of the log and with the cutting edge of one blade offset in the axial and circumferential directions of the drum to overlap the cutting edge of a blade next adjacent and next preceding in the direction of rotation of the drum.

2. The method of claim 1 including providing openings through the drum in registry with each cutter blade for passage of wood wafers into the interior of the drum.

3. Apparatus for producing wood wafers from logs, comprising:

a) a framework, b) a rotary drum mounted on the framework for rotation about an axis, c) log feed means on the framework for moving logs toward the rotary drum, and d) a plurality of wafer cutting blades mounted removably on the rotary drum in a plurality of V-shaped patterns in circumferentially spaced positions around the drum and with the cutting blades in each V-shaped pattern disposed in rotational alignment with the cutting blades in each other V-shaped pattern and with the apex of each V trailing in the direction of rotation of the drum and with the leading base of the V defined by cutting blades at the opposite longitudinal ends of the operating length of the drum, each cutting blade having a cutting edge arranged upon rotation of the drum to cut into a log a predetermined depth and along a line parallel to the longitudinal axis of the log, each cutter blade being offset in the axial and circumferential directions of the drum relative to an adjacent cutting blade, whereby the cut of each blade overlaps the cut of the next preceding blade, whereby to produce wood wafers of predetermined length and thickness.

4. Apparatus for producing wood wafers from logs, comprising:

a) a framework, b) a rotary drum mounted on the framework for rotation about an axis, c) log feed means on the framework for moving the logs toward the rotary drum, d) a plurality of wafer cutting blades mounted removably on the rotary drum and each having a cutting edge arrange upon rotation of the drum to cut into a log a predetermined depth and along a line parallel to the longitudinal axis of the log, each cutter blade being offset in the axial and circumferential directions of the drum relative to an adjacent cutting blade, whereby the cut of each blade overlaps the cut of the next preceding blade, whereby to produce wood wafers of predetermined length and thickness, each wafer cutting blade being U-shape in transverse profile and symmetrical about a transverse central plane and provided with front and rear transverse cutting edges, and e) mounting means on the rotary drum for mounting the blade reversibly for positioning each cutting edge selectively in the operative, forwardly facing wood cutting position.

5. Apparatus for producing wood wafers from logs, comprising:

a) a framework, b) a rotary drum mounted on the framework for rotation about an axis, the rotary drum being open at at least one end, c) log feed means on the framework for moving logs toward the rotary drum, and d) a plurality of wafer cutting blades, a wafer cutting head mounting each wafer cutting blade and mounted removably on the rotary drum, each wafer cutting blade having a cutting edge arranged upon rotation of the drum to cut into a log a predetermined depth and along a line parallel to the longitudinal axis of the log, each cutter blade being offset in the axial and circumferential directions of the drum relative to an adjacent cutting blade, whereby the cut of each blade overlaps the cut of the next preceding blade, whereby to produce wood wafers of predetermined length and thickness, e) a passageway extending from the cutting edge of each blade rearwardly and inwardly to the drum, the drum having a passageway therethrough registering with the passageway from the cutting edge of each blade, for passage of wood wafers into the interior of the drum, and f) an inclined outfeed chute supported in fixed position within the drum and having an outfeed end adjacent an open end of the drum, the chute being arranged to receive wafers from the interior of the drum and to move said wafers outwardly of the drum.

6. Apparatus for producing wood wafers from logs, comprising:

a) a framework, b) a rotary drum mounted on the framework for rotation about an axis, the rotary drum being open at at least one end, c) log feed means on the framework for moving logs toward the rotary drum, d) a plurality of wafer cutting head-supporting arcuate bar segments secured removably to the drum in a plurality of circumferential rings arranged side-by-side along the length of the drum, the confronting ends of adjacent circumferential bar segments being configured to removably mount a wafer cutting head, e) a plurality of wafer cutting blades mounted removably on the rotary drum and each having a cutting edge arranged upon rotation of the drum to cut into a log a predetermined depth and along a line parallel to the longitudinal axis of the log, each cutter blade being offset in the axial and circumferential directions of the drum relative to an adjacent cutting blade, whereby the cut of each blade overlaps the cut of the next preceding blade, whereby to produce wood wafers of predetermined length and thickness, and f) a passageway extending from the cutting edge of each blade rearwardly and inwardly to the drum, the drum having a passageway therethrough registering with the passageway from the cutting edge of each blade, for passage of wood wafers into the interior of the drum.

7. The apparatus of claim 6 including a cavity in the side of each bar segment registering with the wafer cutting head in the adjacent circumferential ring for receiving a side portion of said wafer cutting head and offsetting the associated cutter blade into the rotational path of the next succeeding cutter blade.

8. Apparatus for producing wood wafers from logs, comprising:

a) a framework, b) a rotary drum mounted on the framework for rotation about an axis, c) log feed means on the framework for moving logs toward the rotary drum, the log feed means including a hopper configured for containing a plurality of logs, one upon another, and delivering the bottommost logs to the surface of the drum, with the longitudinal axis of the logs substantially parallel to the rotational axis of the drum, and means for moving the hopper between an operative position for feeding logs to the drum and a retracted position away from the drum, and d) a plurality of wafer cutting blades mounted removably on the rotary drum and each having a cutting edge arranged upon rotation of the drum to cut into a log a predetermined depth and along a line parallel to the longitudinal axis of the log, each cutter blade being offset in the axial and circumferential directions of the drum relative to an adjacent cutting blade, whereby the cut of each blade overlaps the cut of the next preceding blade, whereby to produce wood wafers of predetermined length and thickness.

9. The apparatus of claim 8 wherein the hopper moving means comprises extensible power means interengaging the framework and hopper.

10. Apparatus for producing wood wafers from logs, comprising:

a) a framework, b) a rotary drum mounted on the framework for rotation about an axis, c) log feed means on the framework for moving logs toward the rotary drum, the log feed means including a hopper configured for containing a plurality of logs, one upon another, and delivering the bottommost logs to the surface of the drum, with the longitudinal axis of the logs substantially parallel to the rotational axis of the drum, and d) a plurality of wafer cutting blades mounted removably on the rotary drum and each having a cutting edge arranged upon rotation of the drum to cut into a log a predetermined depth and along a line parallel to the longitudinal axis of the log, each cutter blade being offset in the axial and circumferential directiongs of the drum relative to an adjacent cutting blade, whereby the cut of each blade overlaps the cut of the next preceding blade, whereby to produce wood wafers of predetermined length and thickness.

11. Apparatus for producing wood wafers from logs, comprising:

a) a framework, b) a rotary drum mounted on the framework for rotation about an axis, c) log feed means on the framework for moving logs toward the rotary drum, and d) a plurality of wafer cutting blades mounted removably on the rotary drum and each having a cutting edge arranged upon rotation of the drum to cut into a log a predetermined depth and along a line parallel to the longitudinal axis of the log, each cutter blade being offset in the axial and circumferential directions of the drum relative to an adjacent cutting blade, whereby the cut of each blade overlaps the cut of the next preceding blade, whereby to produce wood wafers of predetermined length and thickness, each wafer cutting blade being U-shape in transverse profile having a central portion and substantially perpendicular lateral sides, the blade having a cutting edge extending substantially continuously across the central portion and along a portion of the sides.

12. The apparatus of claim 11 wherein the wafer cutting blade is symmetrical about a transverse central plane and said cutting edge is provided on both leading and trailing ends of said central portion and sides, and means is provided on the rotary drum for mounting the blade reversibly for positioning each cutting edge selectively in the operative, forwardly facing wood cutting position.

* * * * *